United States Patent [19]

Gwyn et al.

[11] 4,110,193

[45] Aug. 29, 1978

[54] PROCESS FOR PRODUCTION OF HYDROCARBONACEOUS FLUIDS FROM SOLIDS SUCH AS COAL AND OIL SHALE

[75] Inventors: John E. Gwyn, Katy; Scott C. Roberts, Houston, both of Tex.

[73] Assignee: Shell Oil Company, Houston, Tex.

[21] Appl. No.: 776,808

[22] Filed: Mar. 11, 1977

Related U.S. Application Data

[63] Continuation-in-part of Ser. No. 593,403, Jul. 7, 1975, abandoned.

[51] Int. Cl.[2] ..... C10G 1/02

[52] U.S. Cl. ..... 208/11 R; 208/8; 201/12

[58] Field of Search ..... 208/8, 11 R; 201/10, 201/12, 31

[56] References Cited

U.S. PATENT DOCUMENTS

| | | | |
|---|---|---|---|
| 2,725,348 | 11/1955 | Martin et al. | 208/11 R |
| 2,908,617 | 10/1959 | Murphree | 208/11 R |
| 3,008,894 | 11/1961 | Culbertson | 208/11 R |
| 3,020,209 | 2/1962 | Culbertson et al. | 208/11 R |
| 3,020,227 | 2/1962 | Nevens et al. | 208/11 R |
| 3,167,494 | 1/1965 | Crawford | 208/11 R |
| 3,661,722 | 5/1972 | Peters et al. | 201/12 |
| 3,853,498 | 12/1974 | Bailie | 201/31 |

*Primary Examiner*—Delbert E. Gantz
*Assistant Examiner*—James W. Hellwege

[57] ABSTRACT

A retorting process for recovery of hydrocarbonaceous fluids from subdivided solid materials, specifically oil shale, is described wherein the subdivided solid material is preheated, retorted, and subjected to heat recovery after retorting, heat transfer being effected by contacting the subdivided solid material as a dilute-phase fluidized bed in a separate preheating zone with a first particulate heat carrier, and with a second particulate heat carrier in a dense fluidized bed in a retorting zone. Separate particulate heat carriers are employed in such manner that one mass of heat carrier is utilized for preheating the solid material and heat recovery, and a second mass of heat carrier is utilized for retorting of the subdivided preheated solid material.

30 Claims, 1 Drawing Figure

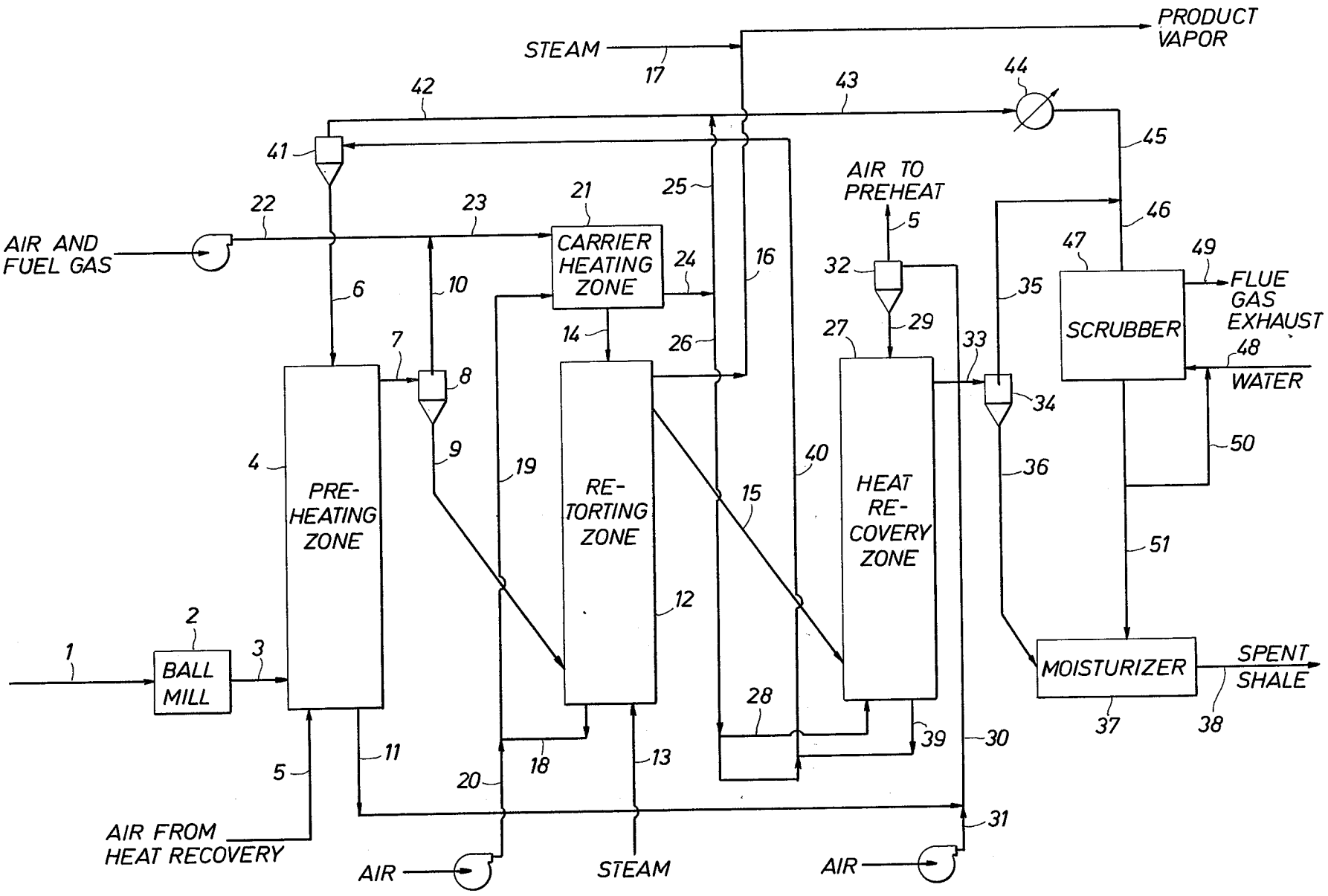
PRODUCT VAPOR
FLUE GAS EXHAUST
WATER
SPENT SHALE
SCRUBBER
MOISTURIZER
AIR TO PREHEAT
HEAT RE-COVERY ZONE
AIR
STEAM
CARRIER HEATING ZONE
RE-TORTING ZONE
PRE-HEATING ZONE
BALL MILL
AIR AND FUEL GAS
AIR FROM HEAT RECOVERY

PROCESS FOR PRODUCTION OF HYDROCARBONACEOUS FLUIDS FROM SOLIDS SUCH AS COAL AND OIL SHALE

BACKGROUND OF THE INVENTION

This application is a continuation-in-part of U.S. Ser. No. 593,403, filed July 7, 1975, now abandoned.

In recent years, an increased and continuing emphasis has been placed on the recovery of hydrocarbonaceous fluids from substantially nonvolatile carbonaceous materials such as oil shale, lignite, coal, industrial and municipal solid wastes and the like, as an alternative to conventional production of petroleum from finite and rapidly depleting and underground sedimentary reservoirs. Previous efforts by both governmental agencies and private industry have demonstrated that these alternative or unconventional carbonaceous material-containing resources can be converted with varying degrees of difficulty into volatile hydrocarbonaceous fluids such as combustible gases, motor fuels, heating and fuel oils and various by-products which have value in the chemical and petrochemical industries. In general, the more attractive of the recovery techniques previously proposed invariably involve heat treatment of the substantially non-volatile carbonaceous material in a manner sufficient to distill or otherwise decompose the solid carbonaceous material into the aforementioned volatile products. These techniques, which can be described in most basic terms as retorting or pyrolysis processes, take on a myriad of forms including batch or continuous schemes utilizing fixed or fluidized beds wherein either a portion of the solid carbonaceous material itself is combusted to supply the pyrolysis heat, or the pyrolysis heat is generated externally and supplied to the process via a gaseous (fluidizing gas), liquid or solid heat carrier.

Of all of the available materials, oil shale is considered by many to be one of the best candidates for processing in such a retorting or pyrolysis scheme since it typically consists of a mixture of a minor amount of solid organic matter (called "kerogen") and a major amount of mineral matter, whose physical and chemical make-up is such that the organic content is really not economically recoverable by any other technique known, except by application of heat. When mined oil shale is retorted, usually at temperatures of about 900° F, the solid organic matter undergoes destructive pyrolysis and a large percentage of the organic matter converts to liquid and light gaseous hydrocarbonaceous fluids with the remainder staying as a carbon-rich residue in the mineral matrix.

In the case of oil shale, several processes have been proposed wherein the pyrolysis or retorting heat is generated outside of the retorting zone itself, and carried into the retorting zone by means of a solid heat carrier in the form of spheres or pellets. In such processes, the oil shale is generally crushed or ground to a rather fine particle size and contacted in one or more process zones with the solid heat carrier to preheat and/or retort the shale.

In one such process, described in an article entitled "Oil Shale Processing Methods" by Thomas A. Hendrickson in the Quarterly of the Colorado School of Mines, Vol. 69 (2), 1974, pages 56–61, mined oil shale is crushed to a minus ½ inch particle size and retorted by milling, co-current contact with a spherical heat carrier (high-alumina-content ceramic balls of ½ inch diameter) in a rotating drum retort vessel. Prior to retorting in this process, it is necessary to preheat the shale particles. This is accomplished by sensible heat transfer from a fluidizing gas in a dilute-phase fluidized-bed "lift pipe" in which the hot fluidizing gases are the flue gases from a gasfired heater used to heat the spherical heat carrier to retort temperatures. In the process, the rotating retort drum can be considered to be a ball mill since, as the oil shales' kerogen is pyrolyzed, the spent shale solids lose strength and become finely pulverized by the spherical heat carrier. The retorting step is carried out at about 950° F, via sensible heat transfer from the spherical heat carrier entering the retort drum at about 1200° F and the solid materials (heat carrier and spent shale) leaving the retort drum at retorting temperatures are screen separated in a trommel. After separation, the spherical heat carrier is transported by a bucket elevator to the gasfired heater, where its temperature is raised to a level requird for recycle to the retorting zone. The hot spent shale fines are passed to disposal after their temperature is reduced in a spent shale cooler.

Various modifications and alterations of one or more steps in this basic process scheme have been proposed in the patent literature. In U.S. Pat. No. 3,008,894, for example, it is proposed to preheat the shale via contact with the spherical heat carrier effluent from the retorting zone and to recover the calorific value in the retorted shale via combustion in the carrier heating step. Other related patents include U.S. Pat. Nos. 3,018,243, 3,020,227 (spherical carrier heating zone design), 3,034,979, 3,058,903, 3,164,541 (use of oil from oil shale retorting to transport spherical heat carrier) and 3,167,494.

A second type of oil shale retorting process utilizing a solid heat carrier is described in U.S. Pat. No. 2,725,348. In this process, mined oil shale is ground to a fluidizable size and contacted countercurrently as an upwardly moving fluidized mass with an extraneous circulating heat carrier in the form of pebbles or balls to preheat the raw ground shale, retort preheated shale and/or recover heat from the spent shale. In one process embodiment, the extraneous heat carrier is utilized to preheat the raw ground shale and to recover heat from the retorted shale with the retorting or pyrolysis step being effected via gas-solids heat exchange in a dense-phase fluidized bed. In a second process embodiment, both the shale pyrolysis or retorting and heat recovery steps are effected by countercurrent heat exchange with the heat carrier in a single vertical column containing two process zones in stacked relationship. In the top process zone, heat is recovered via fluidization and combustion of retorted shale fines, and in the lower process zone the raw shale is retorted, with the heat carrier being passed downwards through the heat recovery zone for heating to retort temperatures, then through the retorting zone where it supplies the heat required in shale pyrolysis. At the lower portion of the bottom process zone, the heat carrier is collected in a relatively cool state after giving up a portion of its heat in retorting and is recycled to the top of the heat recovery zone. This lower portion of retorting zone is also said to function as a raw shale preheater since the raw shale is fluidized through this portion of the process zone in an upward direction into the main section of the retort zone. In both process embodiments specificially described in this patent, it is required that a single or common mass of heat carrier be cycled through all process steps calling for its use. This process requirement causes all of the heat carrier charged to the process to be subjected to rather severe thermal stresses since the bulk of the heat carrier must be heated and cooled to the highest and lowest temperatures encountered in the process. This process trait is undesirable not only because of the tendency of the carrier to attrit under such repeated heating and cooling, but also because it limits the process flexibility in terms of heat carrier selection, i.e., the material must be able to withstand such thermal stresses. Furthermore, while the heat carrier is of a sufficiently small size that it could be pneumatically transported through the process sequence, the apparent heat carrier and shale densities in the fluidized bed process zones, 15–45 lbs/ft$^3$ and 10–30 lbs/ft$^3$, respectively, are such that it is difficult to maintain adequate fluidization without also encountering significant backmixing of shale and heat carrier particles. That is, the bed densities are such that the heat carrier acts more or less as a dense, downwardly moving bed which because of its density will have a tendency to carry shale particles in a direction co-current with its movement thereby effecting backmixing of heated shale particles with upwardly moving fresh shale particles. This could be especially critical in the shale preheating stage since raw shale has a tendency to agglomerate if a portion of the contained kerogen is heated to vaporization temperature and then allowed to cool. In the same respect, this backmixing is also a source of inefficiency in the heat recovery stage of the process since a certain amount of the spent shale could be reheated at the expense of heat transfer to the heat carrier.

Accordingly, it would be advantageous if a retorting method could be developed for recovery of hydrocarbonaceous fluids from substantially non-volatile carbonaceous solids, such as oil shale, employing sensible heat exchange with a solid heat carrier which would not be subject to the deficiencies of the processes mentioned. The invention provides such a process.

SUMMARY OF THE INVENTION

Accordingly, the invention comprises a process for heat treatment of subdivided solid materials containing substantially non-volatile carbonaceous solids in order to convert said non-volatile carbonaceous solids substantially into volatile hydrocarbonaceous fluids, leaving upon heat treatment, a solid particulate carbonaceous material-containing residue. More particularly, the invention is directed to a retorting process for subdivided solid materials, such as crushed oil shale, employing a particulate heat carrier in stage-wise heating and in heat recovery from the retorted particulate residue. According to the invention, particulate heat carrier is passed downwardly at a substantially uniform rate through fluidized beds of the solid materials under the influence of gravitational force to effect the requisite sensible heat transfer, a primary feature of the invention being the segregation of the heat carrier flows in order to minimize overall thermal stress on the heat carrier.

Moreover, it has been found that hydrocarbonaceous fluids can be recovered from subdivided, substantially non-volatile carbonaceous solid material in a highly effective and energy efficient way by a retorting process employing sensible heat transfer from solid heat carrier to preheat the subdivided solid, retort the preheated solid and recover heat from the retorted solid in separate process zones, if the heat carrier flow is segregated in a critical manner and the sensible heat transfer is carried out in a particular fashion. In this process, which is particularly applicable to mined and comminuted oil shale, the subdivided solid is contacted, sequentially, as a fluidized mass in a series of vertically-oriented process zones with particulate solid heat carrier in a manner such that the heat carrier falls or rains through the fluidized mass at a substantially uniform and non-accelerating rate under the influence of gravitational force, said falling rate being controlled by heat carrier properties such as specific gravity and particle size and fluidized bed characteristics such as apparent bed density and fluidizing gas velocity. Tracing subdivided solid material flow through the process, the first or preheating stage and the last or heat recovery stage of the process, involving sensible heat transfer from or to a solid heat carrier, are carried out by fluidizing the solid material in an upward direction at a superficial fluidizing gas velocity at least equal to that known in the art as the "dilute-phase transition velocity," thereby obtaining a dilute-phase, fluidized mass in gas which is contacted countercurrently in the manner described with a particulate heat carrier. In the first or preheating process stage, the subdivided solid material is heated to an elevated temperature below that required for retorting, while in the last or heat recovery stage, heat is recovered from the solid material, now in the form of a particulate solid carbonaceous material-containing residue after being subjected to an intermediate retorting stage. In the intermediate retorting stage of the process, the preheated subdivided solids in the form of a dense, well-mixed fluidized bed are contacted with particulate heat carrier in the manner described previously to obtain a vapor phase containing hydrocarbonaceous solids and a solid particulate phase comprising a solid carbonaceous material containing residue. According to the invention, the flow of particulate heat carrier is segregated in the process scheme such that one mass of heat carrier is utilized in both the preheating and heat recovery stages of the process whereby heat is recovered from the retorted solid material and utilized to preheat incoming solid material while a second mass of heat carrier, heated to high temperature in a separate carrier heating zone, is utilized exclusively for retorting of the subdivided solid material. Preferably, the particle size and specific gravity of the heat carrier is such that it may be pneumatically transported from one process zone to another as necessary in the overall process scheme.

By segregating the particulate heat carrier into two distinct masses and circulating each mass through separate and non-intersecting flow circuits in the process scheme, as descibed above, several distinct advantages are obtained. In the first place, thermal stresses on the total heat carrier charge to the process are minimized in that only a portion of the total charge is subject to the high temperatures required for heat transfer in the retorting step of the process and the heat carrier charge to the retorting step is not subject to the wide temperature variations of prior art processes since it is not utilized to preheat relatively cool incoming solid material. Further, by segregating the heat carrier flow in the manner described, it is now possible to optimize the heat carrier properties for its particular application in the process by utilizing two different heat carriers, one for preheating and heat recovery and one for retorting. This advantage takes on special significance not only because of the potential economic savings involved in using cheaper, more conventional heat carriers in the preheating and heat recovery steps, but also because, as explained below, heat transfer is not a limiting process variable in the retorting phase of the instant process. Thus, the particle size of the heat carrier can be larger in the retorting heat carrier flow circuit for easier separation from the retorted solid but still small enough, if desired, to permit pneumatic transport. Finally, segregation of the heat carrier flow in the manner described optimizes recovery of thermal energy from the process since the heat content of both the retort zone-heat carrier and the heat recovery zone-heat carrier is conserved by return to the retort carrier heating zone and the preheating zone, respectively, while at the same time facilitating discharge of retorted solids at a desirably low temperature as a result of heat exchange in the heat recovery zone with heat carrier cooled to relatively low temperature in the preheating zone.

Further advantages accrue from the particular fashion in which sensible heat transfer is effected between particulate heat carrier and the subdivided solid material in the process sequence of the invention. According to the invention, sensible heat transfer from or to the particulate heat carrier is effected by direct heat carrier contacting of the subdivided solid material as a dilute-phase fluidized mass in the preheating zone, and preferably the heat recovery zone, and as a well-mixed, dense phase fluidized mass in the retort zone. The particular fluidized form of subdivided solid material selected for each process step derives from the finding that optimum process operation is obtained when heat transfer governs the preheating and heat recovery process steps and pyrolysis reaction rate governs the retorting step. Thus, by using a dilute-phase fluidization in the preheating and heat recovery zones, the rate and efficiency of heat transfer is maximized since the sensible heat transfer is countercurrent and the degree of subdivided solid material backmixing is inherently reduced by dilute-phase operation. Again, since the pyrolysis reaction rate governs operation of the retort zone, a dense-phase fluidized bed can be utilized to obtain the longer residence times required for reaction without causing the retort vessel to be prohibitively large. Finally, the properties of the particulate heat carrier in each process flow circuit can be optimized on the basis of heat transfer and reaction rate criteria such that a small particle size, high heat capacity and surface area carrier can be employed to maximize heat transfer in the preheating and heat recovery stages, whereas a larger particle size carrier can be employed in the retorting zone to promote ease of separation from the retorted solids.

The complete process of the invention also includes various solids-gas and solids-solids separation and recovery steps associated with integrated and sequential operation of the preheating, retorting and heat recovery phase of the process as well as recovery of the desired hydrocarbonaceous fluid product of the process. Accordingly, it is convenient to describe the process of the invention, in its most basic terms, as a retorting process for recovery of hydrocarbonaceous fluids from solid material, leaving upon retorting a solid carbonaceous material-containing residue, which comprises:

(a) countercurrently contacting said solid material subdivided to a particle size fluidizable in gas in the form of a relatively cool, upwardly moving fluidized mass in a vertically-oriented preheating zone with a relatively hot first particulate heat carrier thereby transferring sensible heat from the heat carrier to the subdivided solid material and heating said solid material to an elevated temperature below that required for retorting, said subdivided solid material being fluidized in a manner to create a dilute-phase fluidized mass in the preheating zone and said particulate heat carrier being introduced at the upper portion of the preheating zone and having a particle size and density such that it falls through the dilute-phase fluidized mass at a substantially uniform rate and collects in the lower portion of the vertical preheating zone as a relatively cool first particulate heat carrier;

(b) recovering the bulk of said subdivided solid material at elevated temperature in the upper portion of said preheating zone and passing said recovered solid material to a retorting zone;

(c) recovering said relatively cool first particulate heat carrier in the lower portion of said solid material preheating zone, and passing said recovered heat carrier to a heat recovery zone;

(d) introducing said subdivided solid material at elevated temperature into a vertically-oriented retorting zone as a dense-phase, fluidized mass, and contacting said fluidized mass with a second particulate heat carrier heated to a temperature above that required for retorting to transfer sensible heat from the heat carrier to the subdivided solid material to obtain a vapor phase containing hydrocarbonaceous fluids and a solid particulate phase comprising a solid carbonaceous material-containing residue, said second particulate heat carrier being preheated in a separate heating zone and introduced into the upper portion of the retorting zone wherein its particle size and density are such that it falls at a substantially uniform rate and collects in the lower portion of the vertical retorting zone along with a minor amount of entrained solid material and solid carbonaceous material-containing residue;

(e) recovering said hydrocarbonaceous fluids from the upper portion of said retorting zone;

(f) separating said second particulate heat carrier in the lower portion of said retorting zone from solid carbonaceous material-containing residue and passing said separated heat carrier to a carrier heating zone where the carrier's temperature is raised to a level about that required for retorting and returning said second particulate heat carrier after heating to the upper portion of the retorting zone;

(g) removing solid carbonaceous material-containing residue from the upper portion of the dense fluidized phase in the retorting zone and passing the residue to a heat recovery zone;

(h) introducing the solid carbonaceous material-containing residue from the retorting zone into a heat recovery zone and countercurrently contacting said residue with the relatively cool, first particulate heat carrier from the preheating zone to transfer sensible heat from the residue to the first particulate heat carrier and form a relatively cool particulate residue, and returning said relatively hot first particulate heat carrier to the preheating zone; and (i) recovering relatively cool particulate residue from the heat recovery zone.

In the preferred form of the invention, the carbonaceous material-containing residue is fluidized in the heat recovery zone in a manner to create a dilute-phase fluidized mass in the heat recovery zone and the first particulate heat carrier is introduced in the upper portion of the heat recovery zone, the first particulate heat carrier having a particle size and density such that it falls through the dilute-fluidized mass at a substantially uniform rate and collects in the lower portion of the heat recovery zone; and the first particulate heat carrier in the lower portion of said heat recovery zone is recovered and passed to the solid material preheating zone where it supplies sensible heat for preheating the solid material containing non-volatile hydrocarbonaceous material.

Detailed Description of the Invention

As indicated, the process of the invention is generally applicable to the recovery of hydrocarbonaceous fluids from any solid material containing substantially non-volatile carbonaceous matter which can be subdivided into a particle size fluidizable in gas without depleting its carbonaceous matter content. Suitable solid materials include mined oil shale, various coals and lignite, wood and bark waste, agricultural residues, biotreater sludges, industrial and municipal solid wastes and the like. Preferred solid material feedstocks for the process include oil shale, coals such as anthracite, bituminous and subbituminous and lignite. These preferred feedstocks generally have organic or carbonaceous matter contents ranging from in excess of 95% by weight for certain anthracite coals down to 10% by weight or less for certain oil shales with the balance being inorganic minerals and water. Since the process of the invention essentially involves destructive pyrolysis of the contained carbonaceous matter in the solid feedstock, the fluid product obtained, though characterized herein as hydrocarbonaceous in nature, typically consists of a variety of chemical constituents including gaseous and liquid products. For example, in the case of oil shale retorting or pyrolysis, a large percentage of the contained solid organic matter or kerogen will be converted to liquid products, a minor portion to gaseous hydrocarbon products and the remainder will stay with the inorganic components of the shale as carbonaceous residue in the inorganic matrix. The liquid or shale oil product obtained generally contains a large hydrocarbon fraction as well as a variety of organic-type compounds containing oxygen, nitrogen and sulfur constituents. The overall carbon to hydrogen (C/H) weight ratio in a typical shale oil obtained by pyrolysis in the instant process generally ranges from about 7 to about 9. In the case of coals and lignites the liquid product is a coal tar of similar character, through more sulfur and nitrogen compounds may be present, with a C/H ratio in the range of about 8 to about 16. The solid residue in the case of coal is typically a high calorific value char of higher carbon content that that obtained from oil shales. The process of the invention finds special application in recovering hydrocarbonaceous fluids from oil shale such as that found in abundance in the Western United States and for this reason oil shale is most preferred as feedstock for the process.

Before recovery of hydrocarbonaceous fluids can be effected by the process of the invention, it is necessary that the solid material containing substantially non-volatile carbonaceous matter be subdivided or comminuted to a particle size fluidizable in gas. The comminution techniques suitably employed in preparing the feedstock are quite conventional in nature and generally involve grinding or crushing of the solid material to the desired particle size. In the case or preferred feedstocks such as oil shale, it is desirable to employ conventional grinding devices such as ball mills with provision being made to separate and recycle coarse materials back through the ball mill. Separation of shale of the desired particle size from the oversize may be accomplished by elutriation with gas or by screening with the remaining coarse shale being conveyed back to the grinder. In the case of softer and more malleable feedstocks such as wood and bark waste, the desired comminution is more readily obtained with a crushing or chopping device such as a hammer mill. The specific particle size to which the solid feedstock is reduced will depend to a certain degree on the bulk density of the feedstock. For mined oil shale and other materials having specific gravities in the range of about 1 to 2.5, it is desirable to reduce the particle size of the largest particles to ⅛ inch or less. This will produce a mass of particulate shale which is readily fluidizable at conventional fluidizing gas velocities. Preferably, the oil shale is ground to a particle size of 1/16 inch or less in order to promote separation of the solid shale particles from particulate heat carrier in the subsequent process stages and to allow the ground shale to be pneumatically transported to the first or preheating stage of the process at minimum carrying gas velocities. The crushing or grinding operation occurs essentially at ambient temperatures with little addition or evolution of heat such that the subdivided solid material enters the preheating stage of the process at relatively cool temperatures approximating ambient, i.e., 100° F or less for subdivided oil shale.

The first or preheating stage of the process is carried out in a vertically-oriented process zone wherein the relatively cool subdivided solid material in the form of an upwardly moving, dilute-phase fluidized mass in contacted countercurrently with a relatively hot, first particulate heat carrier to effect sensible heat transfer to the solid material and heat same to an elevated temperature below that required for retorting. To effect heat transfer in this first process zone the subdivided solid material, typically at a temperature 100° F or less for oil shale, is introduced at the lower portion of the vertically-oriented zone along with a fluidizing carrier gas at a gas velocity sufficient to create an upwardly moving dilute-phase fluidized bed of solid material in the process zone. This dilute-phase fluidized bed condition is created when the fluidizing gas velocity exceeds a critical velocity known in the art as the "dilute-phase transition velocity", e.g., see U.S. Pat. No. 3,597,327 and U.S. Pat. No. 3,855,070. At this critical velocity the fluidized bed density abruptly decreases with a concomitant increase in net upwards velocity of the bulk of the fluidized subdivided solids in the bed. Under these conditions, the fluidized bed thins out in a vertical direction and the path traveled by any given fluidized particle becomes less random and more fixed in the direction of fluidizing gas flow, though a certain amount of refluxing is still encountered due to the formation of stringers of fluidized particles in the bed which quickly diffuse into the upwardly moving fluidizing gas. The net effect of such dilute phase fluidization is to regularize the rate of movement of any given fluidized particle through the fluidization stage, minimize backmixing of fluidized particles and place limits on residence time in the fluidized bed process zone since substantially all of the fluidized particles are thereby conveyed out the upper portion of the vertical process zone of the invention. When subdivided oil shale or other solid materials of similar particle size and density are employed, a dilute-phase fluidized bed condition can be achieved with superficial fluidizing gas velocities of about 8 to 30 ft/sec and solids to fluidizing gas weight ratios of 6–20 to 1, with superficial gas velocities of 10 to 25 ft/sec and solids to gas ratios of 8–20 to 1 being preferred. With these process parameters, the apparent fluidized bed densities suitably range from 1–5 lb/ft$^3$ with densities in the range of 2–4lb/ft$^3$ being preferred.

The type of fluidizing gas employed in this stage of the process is not critical provided it does not cause spontaneous combustion or otherwise react with and substantially deplete the solid carbonaceous material in the subdivided solid at the temperatures achieved in preheating. Suitable non-interferring fluidizing gases include dilute oxygen-containing gases such as air or flue gas-diluted air, flue gas and inert gases such as nitrogen. It is preferred to employ a dilute oxygen-containing gas such as flue gas diluted air in this step of the process since any preheated solid material which passes out of the top of the preheating zone, having a particle size sufficiently small to avoid gas-solids separation and solids recovery for charge to the retort zone, can be passed along with its gas carrier to the heating zone for the second particulate heat carrier to supply a portion of the heat required in that zone via combustion (see below). In this manner the thermal efficiency of the process will be maximized and its energy requirements reduced by recovering the calorific value of subdivided solid material feedstock which otherwise might be lost in gaseous or associated scrubber effluent.

As mentioned previously, the dilute-phase fluidized bed of subdivided solid material is preheated in this first process zone by countercurrent contact with a relatively hot, first particulate heat carrier such that the temperature of the subdivided solid material leaving the upper portion of the preheating zone is at an elevated level, but below that required for retorting. In this process zone, countercurrent contact and sensible heat transfer from the relatively hot, particulate heat carrier to the relatively cool, subdivided solid is established by introducing the particulate heat carrier at the top or upper portion of the vertical process zone and passing it in a downward direction at a uniform rate through the upwardly moving dilute-phase fluidized bed of subdivided solid material, said relatively hot, particulate heat carrier being returned from the lower portion of the preheating zone as will appear hereinafter. That is, the particulate heat carrier, usually in the form of spheres, pellets or granules, is introduced at a controlled rate uniformly across the cross-section of a top region of the preheating zone via suitable deflecting device and allowed to fall or rain at a substantially uniform, non-accelerating rate under the influence of gravity against the rising stream of fluidized solid material. Designation of the flow of particulate heat carrier in this manner is intended to denote that the individual carrier particles cascade or fall under the influence of gravitational force at apparent bed densities sufficiently low that free movement of the heat particles is not restricted by carrier particle population in the zone, thereby precluding the use of a dense, downwardly moving bed of heat carrier particles. Further, the rate of carrier particle descent through the bed is controlled to a sufficient degree by the opposing fluidizing gas force that it does not continuously accelerate with the action of gravitational force. Under these conditions the heat carrier particles experience a certain amount of sideways and even upwards movement on their descent through the fluidized bed; however, the net flow is in a downwards direction at a substantially uniform rate and backmixing is minimized due to the rate of upward movement of subdivided solid material in the dilute fluidized phase. For countercurrent contact of a dilute-phase fluidized bed of subdivided oil shale or other like material according to the invention, the apparent heat carrier densities in the preheating zone will generally range from 1 to 14 lbs/ft$^3$ with resultant heat carrier falling velocities of about 1 to 10 ft/sec in order to obtain the desired heat carrier flow characteristics.

The flow or rate of descent of the first particulate heat carrier through the preheating zone according to the invention is controlled by several factors well known to those skilled in the art. Principal factors include the particle size and density or specific gravity of the heat carrier particles, the fluidized particle bed density and the opposing fluidizing gas velocity. The fluidizing gas velocity, of course, will vary with the specific type of subdivided solid material feedstock employed. With the aforementioned fluidizing gas velocities for the preferred oil shale feedstock and other materials of like particle size and specific gravity, it is desirable to employ heat carriers having a specific gravity of from 2 to 8 and a particle size in the range of 1/16 to 3/8 inch. In any case, it is preferable that the particle size of the heat carrier be larger by a factor of at least two over the particle size of the subdivided solid material to insure effective countercurrent contact and adequate separation of heat carrier from subdivided solid material. Since the primary objective of the preheating (and heat recovery) stage is heat exchange, it is desirable to use heat carriers having as small as possible particle size to maximize heat transfer. In this same regard, it is desirable to use a heat carrier having as high a heat capacity as possible. Suitable heat carriers have heat capacities in excess of 0.10 btu/lb/° F with carriers having capacities in the range of 0.12 to 0.25 btu/lb/° F being preferred. In any case, the specific gravity and particle size of the particulate heat carrier employed in the invention will preferably be such that it can be readily transported by pneumatic action in a carrier gas throughout the process flow scheme.

The composition of the heat carrier employed in the preheating (and heat recovery) phase of the instant process is rather conventional and includes any solid material having the above-mentioned heat capacity which is relatively inert to chemical and physical degradation in the process. Suitable materials include aluminum, iron, steel and lead alloys, ceramic materials such as highdensity alumina and naturally occurring silica-containing materials such as gravel. Pea gravel possesses a suitable heat capacity and can be employed in the instant process without risk of thermal degradation, in contrast to prior art processes, since its use is limited to the preheating and heat recovery stages of the process where extremely high temperatures and corrosive conditions are not encountered. Most preferred, because of their high-heat capacities, high densities and resistance to chemical and physical degradation, are the ceramic materials such as high-density alumina.

The extent to which the subdivided solid material is preheated by countercurrent contact with the first particulate heat carrier in the preheating zone will depend to a certain degree on the nature of the solid material employed and the temperature to which the heat carrier is raised by heat exchange in the heat recovery zone. For most potential carbonaceous material-containing solid feedstocks to the process, it is desirable that the temperature of the subdivided solid material be raised to an elevated level which is at least 200° F below the temperature required for retorting. For feedstocks such as subdivided oil shale, which tend to give off gaseous and light liquid hydrocarbonaceous vapors and become tacky at temperatures even further below the temperature desired for retorting, it is preferred that the temperature of the subdivided material leaving the top of the preheating zone be at least about 300° F below the temperature required for retorting. Specifically in the case of oil shale, satisfactory operation of the preheating zone is obtained when the temperature of the incoming oil shale at 100° F or less is raised to a temperature not exceeding 600° F in the preheating zone by countercurrent contact with the first particulate heat carrier which has been heated to a temperature of between about 600° and 700° F in the heat recovery zone. Preferably, the temperature of the preheated oil shale will range from 500° to 600° F with temperatures of about 550° F being most preferred. Under these conditions sensible heat transfer from the heat carrier will reduce its temperature at the carrier outlet from the preheating zone to about 100° to 250° F. Using the aforedescribed dilute-phase fluidized bed of subdivided solid material and countercurrent contacting with heat carrier, it is generally necessary that the average residence time of subdivided solid material in the preheating zone be maintained between about 15 and 50 seconds to obtain the desired heat transfer.

The vertically-oriented preheating zone according to the invention may be of conventional design, typically being in the form of a vertically-oriented column or standpipe with appropriate inlets and outlets for subdivided solid material and particulate heat carrier. Preferably, the preheating zone is in the form of a vertically-oriented, cylindrical column which is internally equipped with a plurality of baffles or grid plates to promote staging of the countercurrent heat exchange and further reduce backmixing. When subdivided solid material feedstocks such as oil shale or coal are employed having significant water contents, it is most preferable to employ a vertical column which increases in diameter or internal cross-sectional area with increasing height to compensate for any increase in gas volume due to water vaporization. Suitable preheating zone designs in this case would include those having inverted cone shape and cylindrical columns whose internal diameter is increased in one or more stages in an upward direction. For practical scale preheating of oil shale and like solid materials, the preheating zone is suitably 8 to 20 feet in diameter and 50 to 200 feet in height. Preferably, the height of the preheating zone is about 100 feet for oil shale preheating according to the conditions described above. When baffles or grid staging are employed on a practical scale, it is preferable to use about 5 to 20 sets of baffles or horizontal grid plates spaced at uniform intervals of about 5 to 20 feet along the axis of the preheating zone.

After countercurrent contact and sensible heat exchange in the preheating zone according to the process of the invention, the subdivided solid material, now at a relatively hot temperature, but below that required for retorting, passes out the top or upper portion of the preheating zone and the first particulate heat carrier cooled to a relatively low temperature collects at the bottom of the preheating zone. The relatively hot subdivided solid material may be recovered from the upper portion of the preheating zone via conventional gas-solids separation means, such as one or more high-efficiency, high-load cyclone separators, and is passed to the retorting zone. In this gas-solids separation step substantially all, e.g., 98%, of the preheated solid material may be recovered from the fluidizing gas with conventional techniques such that only a very small quantity of very finely-divided solid material remains in the fluidizing gas. This micron-sized solid material can be removed from the fluidizing gas in a conventional gas scrubbing device, e.g., water scrubber or in the case where a dilute oxygen-containing fluidizing gas is employed, it can be passed directly along with its entraining gas to the heating zone for the second particulate heat carrier to supply a portion of the heat required in that zone via combustion as is detailed below. The relatively cool particulate heat carrier which collects in the lower portion or boot of the vertically-oriented preheating zone will typically contain a minor amount of entrained subdivided solid material. Due to the nature of the fluidized bed operation in this zone, i.e., dilute-phase fluidization, the amount of entrained solid material in the lower portion of the zone is generally quite small, amounting to only about 5% or less of the total solids mass which collects at the bottom of the zone. The relatively cool particulate heat carrier may be separated from entrained solid material in the lower portion of the zone by suitable solids-solids separation means, e.g., by elutriation, and is transported, preferably pneumatically, to the heat recovery zone, detailed below. If elutriation is employed, the gas employed in separation of entrained solid material by elutriation is suitably the same gas as is utilized for fluidization in the preheating zone. To effect elutriation, the stripping gas is compressed to a pressure above that required for fluidization in the preheating zone and passed through the heat carrier mass at the bottom of the preheating zone at a superficial velocity of 10 to 50 ft/sec. The entrained solid material freed by elutriation is picked up by the fluidizing gas as part of the dilute-phase fluidized mass. Other means of separation, such as sieving or jigging, may be employed, and other means of transporting the first particulate heat carrier, such as buckets, belts, etc., may be used.

To effect retorting or pyrolysis of the substantially non-volatile carbonaceous matter contained in the preheated, subdivided solid material, the preheated solid is passed into the vertically-oriented retorting zone as a dense-phase fluidized mass and contacted with a second particulate heat carrier which is heated to a temperature above that required for retorting in a separate carrier heating zone, said second particulate heat carrier also falling or raining through the dense fluidized bed at a substantially uniform rate under the influence of gravity. While sensible heat transfer from the second particulate heat carrier is essential for pyrolysis of the preheated solid material in the retorting zone, the controlling process variable in this zone is not heat transfer, but rather, it is the pyrolysis reaction rate. That is, the residence time at pyrolysis temperatures required for the substantially non-volatile carbonaceous matter contained in the solid material to undergo thermal conversion (internal hydrogenation in the case of oil shale) into gaseous and liquid fluids of a hydrocarbonaceous nature, leaving a solid carbonaceous material-containing residue, exceeds the residence time required for heating to maintaining at the pyrolysis temperatures.

According to the invention, the requisite residence time for pyrolysis is obtained by introducing preheated solid material at a controlled rate, preferably by gravity feed from the upper portion of the preheating zone, into the lower region of the retorting zone with sufficient gas to initiate fluidization such that dense, well-mixed fluidized bed of solid material is created in the retorting zone. The fluidized bed formed in this zone corresponds reasonably well with what is known in the art as a dense fluidiz fluidized bed in that it exhibits quasi-liquid behavior having a definable upper surface at which the bed density abruptly decreases. The superficial gas velocities used to initiate fluidization in this zone are considerably below those employed for dilute-phase fluidization in the preheating stage. In the case of preheated oil shale and like materials, suitable dense-phase fluidization can be obtained with superficial gas velocities in the range of about 2 to about 8 ft/sec. The gas to solids ratio in the dense fluidized bed according to the invention is essentially meaningless as a process control variable because the vapor or gas formed on pyrolysis of the solid material adds significantly to the gas flow through the bed (a factor of up to about 10 in the case of oil shale). This pyrolysis gas or vapor is a significant factor in fluidization, though, since it rises up the vertical retort zone and adds to the fluidization potential of the zone. For preheated oil shale and other materials of like particle size and specific gravity, it is preferable to maintain an apparent density in the dense fluidized phase of the retorting zone of above 15 lbs/ft$^3$ in order to insure adequate residence time.

The fluidizing gas employed in the retorting zone should be of the type which will not support combustion of carbonaceous matter. Suitable noninterferring gases include nitrogen, gaseous mixtures made up substantially of light hydrocarbons ($C_4$ and below), oxygen-deficient flue gas and steam. In this application, preference is given to steam since it simplifies the plant start-up procedure and subsequent separation. It can also be readily used for elutriation of entrained solid material and solid carbonaceous material-containing residue from the particulate heat carrier which collects at the bottom of the retort zone (see below).

Sensible heat transfer and heating of the preheated, subdivided solid material to pyrolysis temperatures is effected in the retorting zone by passing a second particulate heat carrier down through the dense-phase fluidized bed in a manner quite similar to that employed in the preheating zone. That is, the second particulate heat carrier, heated to an appropriate temperature in a separate carrier heating zone, is introduced at a controlled rate uniformly across the cross-section of an upper region in the vertically-oriented retorting zone via suitable deflecting device or distribution grid and allowed to fall or rain at a substantially uniform, non-accelerating rate under the influence of gravity through the dense fluidized bed, against the rising stream of fluidizing gas. As in the preheating zone, the flow of heat carrier through the retorting zone is controlled so that the use of a dense, downwardly moving bed of heat carrier is precluded; the apparent heat carrier densities in this zone being in the range of 5–15 lbs/ft$^3$ for retorting of subdivided oil shale and like materials. Because of the increased fluidized bed densities encountered in dense phase operation according to the invention, the falling velocity of particulate heat carrier through the fluidized bed is generally below that encountered in the dilute-phase, preheating zone. For dense fluidized beds such as those obtained on fluidization of preheated oil shale and materials of like particle size and specific gravity, the average carriage falling velocities are typically in the range of about ⅛ to about 1 ft/sec.

Due to the inherent nature of the dense-phase fluidized bed in the retorting zone, being a relatively well-mixed mass of fluidized particles, the bulk of the subdivided solid material present in the retorting zone is maintained at the temperature level required for pyrolysis. For most conventional subdivided solid material feedstocks useable in the process of the invention, this pyrolysis or retorting temperature will range from about 800° to about 1100° F. To maintain this pyrolysis temperature range in the dense fluidized bed, it is necessary to heat the second particulate heat carrier in the separate carrier heating zone to a level such that it passes into the fluidized bed at a temperature of about 200° to 700° F above the temperature required for retorting. This temperature differential is adequate to compensate for the cooling effects of the lower temperature, subdivided solid material introduced at the bottom of the zone, and, as a result, a constant temperature in the pyrolysis range is maintained in the fluidized bed. For subdivided oil shale and other preferred solid material feedstocks to the process, the pyrolysis temperature or temperature of the bulk of the dense fluidized bed in the retorting zone suitably ranges from 850 to 1100° F with temperatures in the range of 850° to 950° F being preferred. Under these conditions, the temperature of the second particulate heat carrier passed into contact with the dense fluidized bed in the retorting zone suitably ranges from 1100° to 1600° F, with temperatures in the range of 1200° to 1500° F being preferred; said subdivided oil shale being introduced into the retorting zone at temperture approximating the preferred range of preheating temperatures, i.e., 500° to 600° F.

Retorting of preheated solid material according to the invention yields a vapor phase containing hydrocarbonaceous fluids and a solid particulate phase comprising a solid carbonaceous material-containing residue. Thus, the dense fluidized bed in the retorting zone also contains retorted particulate residue in admixture with the subdivided solid material. This particulate residue tends to be of somewhat finer particle size than the subdivided solid material feedstock due to both thermal and physical stresses in the retort zone combined with the loss of pyrolyzed carbonaceous matter, which many times functions as a binder for the solid material. This is especially true for subdivided oil shale where the retorted residue exhibits a substantial tendency to attrit into a fine powder when subject to physical stress. When subdivided and preheated oil shale is subject to pyrolysis at the retort zone temperatures given above and the average residence time of subdivided oil shale in the dense fluidized bed is controlled between about 5 and 20 minutes, the fluidized particle composition in the dense bed is completely or almost completely in the form of retorted residue, i.e., less than 10% of the fluidized particles in the bed being unretorted oil shale. The retorted particulate residue in this case generally contains less than 6% by weight solid carbonaceous matter.

Upon completion of pyrolysis in the dense-phase fluidized bed, retort zone of the invention, the subdivided solid material, now completely or substantially completely in the form of the particulate carbonaceous material-containing residue, is withdrawn from the dense fluidized phase and transported to the heat recovery zone, detailed below. This particulate residue at a temperature approximating the retort zone temperatures, e.g., 850°–1100° F in the case of oil shale, is suitably withdrawn from the upper portion of the dense bed in the retort zone in any conventional manner, e.g., cyclindrical overflow well or weir on the periphery of the retort zone, and transported, e.g., by gravity feed or pneumatic action, to the heat recovery zone. The hydrocarbonaceous fluid-containing vapor phase obtained on pyrolysis passes in admixture with the fluidizing gas, in an upwards direction through the dense fluidized bed into the upper portion of the retorting zone. A minor amount of finer particle size solid material and retorted particulate residue is entrained in this upwardly moving gas mixture as it passes through the dense fluidized bed. This finely-divided material, which forms a dilute suspension in the vapor phase above the fluidized bed, is suitably removed from the entraining gas by one or more internal cyclone separators and returned to the bed to retain the fluidized bed inventory. Since the potential for vapor condensation exists in this vapor space above the dense fluidized bed, it is preferred to inject superheated steam into this vapor section to minimize cooling and condensation. After removal of entrained solids, the hydrocarbonaceous fluid-containing vapor phase is passed out the top of the retort zone to conventional product recovery where it is condensed, fractionated and otherwise processed into useful components.

The second particulate heat carrier, which is cooled to near retorting temperatures as it passes downwardly through the dense fluidized bed, collects in the lower portion or boot of the vertically-oriented retorting zone along with a minor amount of entrained solid material and solid carbonaceous material-containing residue. This particulate heat carrier, now at a temperature approximating that of the dense fluidized bed, e.g., 850° to 1100° F in the case of subdivided oil shale retorting, is separated from entrained solid material and particulate residue in the lower portion of the zone by suitable solids-solids separation means, such as elutriation, and transported, e.g., pneumatically, to the carrier heating zone, discussed below. If elutriation is employed, the stripping gas employed in separation of entrained material is suitably the same gas as is utilized for fluidization in the retorting zone. Preferred stripping gases for elutriation in the retorting zone include steam and gases made up substantially of light ($C_4$ and below) hydrocarbons. The entrained solid material and particulate residue, freed from the heat carrier at the bottom of the retorting zone, is returned to the dense fluidized bed for further process.

The physical and chemical make-up of the heat carrier employed in the retorting zone, i.e., the second particulate heat carrier, is similar to the first particulate heat carrier employed in preheating and heat recovery. That is, the second particulate heat carrier is also suitably in the form of spheres, pellets or granules of a particle size larger than the particle size of the subdivided solid material and particulate residue by at least a factor of two. In fact, the second particulate heat carrier may be identical in composition and particle size to the heat carrier employed in preheating and heat recovery. This is convenient because a common source can be utilized for both heat carriers thereby avoiding costs associated with two separate heat carrier handling and storage facilities. However, since reaction rate and not heat transfer is controlling in the retort zone of the invention, it is generally preferable to employ a larger particle size heat carrier in this zone to promote easier separation from the fluidized particles. Specifically, in cases where subdivided oil shale and other materials of like particle size and specific gravity are subject to retorting in the process of the invention, it is preferable to employ heat carriers having particle sizes in the range of $\frac{1}{8}$ to $\frac{3}{8}$inches. In these 2.5 and 8 and a heat capacity of from 0.10 to 0.30btu/lb/° F with heat capacities of from 0.18 to 0.25 btu/lb/° F being preferred. Suitable heat carrier compositions for the retorting phase of the process include many of the materials mentioned previously as having application in the preheating and heat recovery phases of the process. In particular, particulate heat carriers fabricated from iron, steel, and ceramic materials such as high density alumina are well suited for use in the retorting phase of the process. Because a greater resistance to high temperatures, thermal shock and chemical attack is generally required in the retorting zone as contrasted to the preheating and heat recovery zones, naturally occuring mineral-type materials such as gravel are generally not suitable and ceramic materials such as high-density alumina are generally preferred. In any case, the particle size and specific gravity of the second particulate heat carrier is such that it can be, if desired, pneumatically transported from one process zone to another as required by the process flow scheme.

The design of the retorting zone according to the invention preferably differs somewhat from the preheating zone in order to accommodate the increased amounts of evolved vapors while maintaining the dense-phase fluidized bed operation. Accordingly, the retorting zone is preferably a vertically-oriented chamber of greatly reduced cross-section at its bottom end and expanded cross-section in its upper regions with an overall length in the vertical direction which is somewhat reduced from that required for the preheating zone. Accordingly, the ratio of the length of the retorting zone to its width in the upper region will generally not exceed 3. Suitable constructions for the retort zone include an upright cylindrical column having a reduced diameter or conical shape at its lower end, or merely an inverted cone with the base of the cone forming the top of the retort zone. If a cylindrical column is employed, it is desirable to increase its diameter one or more times in an upward direction along its axis to accommodate the increased vapor phase volume as retorting goes to completion without disturbing the dense fluidized bed operation. In the case of oil shale retorting, the retort zone is preferably sized such that the height of the dense bed is in the range of 10–60 feet and the diameter between 20 and 40 feet, with an overall retort zone height of from 50 to 125 feet. This retort zone is equipped with appropriate inlets and outlets for subdivided solid material, particulate residue and heat carrier, as well as a means for introducing fluidizing gas (distribution grid or diaphram) and internal cyclone separators for knockdown of entrained particles in the vapor overhead. In an alternative embodiment of the invention, it is preferred to stage the dense fluidized bed retorting phase of the process by disposing one or more horizontally-oriented separator grids, baffles or grates along the length of the retort zone in the area where the dense fluidized bed occurs. These interstage separator grates, or the like, reduce the retort cross-sectional area by 50 to 85%, thereby raising the fluidizing gas velocity to a level high enough to entrain and spout particles into the next stage. The net effect of using such stage separators is to minimize backmixing of fluidized particles while ensuring that larger fluidized particles do not accumulate in the lower regions of the fluidized bed. By reducing backmixing, the residence time required for retorting is also reduced such that when 3 or more interstage separators are employed it is possible to cut the retort residence time by a factor of 50% or more. In this context, it is most preferred to employ 3-5 interstage separators of the type previously described, e.g., grates fabricated from I beams. In this system, it is desirable to segregate the flow of heat carrier to the retort zone such that a portion of fresh heat carrier is introduced into each stage of the fluidized bed.

As mentioned previously, the second particulate heat carrier utilized for sensible heat transfer in the retorting zone is heated to a temperature above that required for retorting in a separate carrier heating zone prior to being placed into contact with the dense fluidized bed in the retorting zone. This separate carrier heating zone may be rather conventional in nature, being e.g., a combustion heater or furnace wherein the second particulate heat carrier is heated indirectly or directly with the hot gaseous product of combustion. Suitable carrier heating zone designs include those wherein the particulate heat carrier is heated directly by contact with the hot combustion gas in a cross-current moving bed or a co-current entraining bed. It is also possible to rain the particulate heat carrier particles down through an upwardly moving stream of hot combustion gas in a manner quite similar to that employed in the preheating stage of the process to effect countercurrent heat exchange. As a general matter, supplemental air and fuel will be required to generate the necessary heat for carrier heating. However, as mentioned previously, the preheated solid material fines not recovered by gas-solids separation at the top or upper portion of the preheating zone can also be utilized as a fuel source in this carrier heating zone, if a dilute oxygen-containing gas is employed as the fluidizing gas in the preheating zone. In this preferred embodiment, the solid material fines are mixed with a portion of supplemental fuel and fed to the combustion heater along with their carrier gas which, itself, satisfies part of the oxygen requirements for combustion. The hot flue gas which is generated by combustion in the carrier heating zone can be used to generate high pressure steam for the process. Preferably, the hot flue gas stream is split into at least one other stream such that a portion of the hot gas is utilized as the fluidizing gas source in heat recovery (see below). Alternatively, additional portions of the hot flue gas may be used as the transporting gas to move second particulate heat carrier, pneumatically, from the bottom of the retort zone to the carrier heating zone; as the transporting gas to move the first particulate heat carrier from the bottom of the heat recovery zone to the top of the preheating zone; and as the source of fluidizing gas in the retorting zone. By any or all of these measures, the heat content of the flue gas is conserved in the process. From a procedural standpoint, heating of the second particulate heat carrier may be effected in the carrier heating zone by transporting heat carrier, preferably pneumatically, which collects in the lower portion of the retorting zone after separation from the residue, preferably by elutriation, to the carrier heating zone, raising its temperature to that required for retorting in the carrier heating zone and passing it back into the upper portion of the retort zone via appropriate piping and valving. In this manner, a closed loop for heat carrier flow around the retort zone may be established and the heat content of the second particulate heat carrier is thereby conserved. While flue gas from the carrier heating zone may be employed to pneumatically transport heat carrier from the retorting zone to the carrier heating zone, air is preferably employed for this purpose. By using air as the carrier gas for pneumatic transport to the carrier heating zone, at least a portion of the air requirements for combustion in that zone can be satisfied giving the carrier air a two-fold function in the process.

The solid, particulate carbonaceous material-containing residue recovered from the retorting zone is subject to heat recovery by countercurrent contact with the relatively cool, first particulate heat carrier separated at the bottom of the preheating zone. Preferably, the heat exchange is carried out in much the same manner as was employed in the preheating zone. That is, the particulate residue is preferably introduced at temperatures approximating those employed in retorting as an upwardly moving, dilute-phase fluidized mass in the lower portion of a vertically-oriented heat recovery zone and countercurrently contacted with the first particulate heat carrier from the bottom of the preheating zone, said first particulate heat carrier being introduced at the top or upper portion of the vertical heat recovery zone and passed downwardly at a substantially uniform, non-accelerating rate under the influence of gravity through the upwardly moving dilute-phase fluidized bed. In this case, the sensible heat exchange is such that the particulate residue leaves the upper portion or top of the heat recovery zone at a relatively cool temperature and the first particulate heat carrier collects in the lower portion of the heat recovery zone at a temperature approximating that required for sensible heat transfer in the preheating zone. In this preferred embodiment, the operation of the heat recovery zone, with the minor exceptions noted below, is in all respects identical to the operation of the preheating zone. Thus, the same process definitions relative to dilute-phase operation and heat carrier flow detailed for the preheating zone apply to the heat recovery zone. Further, almost all of the process parameters defining fluidized bed and heat carrier flow characteristics for preheating of the preferred oil shale and like feedstocks are also applicable to the heat recovery zone operation with the corresponding retorted products. The only important distinction in this regard is that the particulate residue passed into the heat recovery zone will generally have a smaller particle size than the subdivided solid material fed to the preheating zone. For typical feedstocks, this particle size difference is such that the average particle size of the retorted residue is less than half of the average particle size of the subdivided feedstock. Such differences in particle size are not sufficient to upset or change any of the preheating zone process parameters detailed previously. Other methods of heat recovery may be employed.

If the preferred heat recovery scheme is employed, the fluidizing gas used is preferably hot flue gas from the carrier heating zone. However, the use of other gases such as steam or an inert gas such as nitrogen is not precluded. After sensible heat exchange in the heat recovery zone, the fluidizing gas may be separated from the entrained particulate residue, now in a relatively cool condition, by means of conventional gas-solids separation, such as one or more high efficiency, high-load cyclone separators. After removal of all or substantially all of the entrained solids by gas-solids separation, the fluidizing gas, combined with other cool gas disposal streams in the process, e.g., flue gas from the carrier heating zone and fluidizing gas from the preheating zone after their heat contents have been recovered, is vented to the atmosphere. The relatively cool particulate residue separated from the upper portion of the heat recovery zone is further cooled via direct or indirect means, e.g., by contact with water spray, and sent to disposal or is subjected to further processing to recover its carbonaceous and/or mineral matter content. The first particulate heat carrier which collects in the lower portion or boot of the heat recovery zone will typically contain a minor amount of entrained particulate residue. This entrained particulate residue, which is present in a minor amount similar to that found in the lower portion of the preheating zone, is separated from the heat carrier by a solids-solids separation means equivalent to that employed in the preheating zone. When elutriation is employed to effect separation of entrained particulate residue in this zone, the stripping gas is preferably a substantially oxygen-free gas such as flue gas, steam or nitrogen. After solids-solids separation, the first particulate heat carrier, now at a temperature approximating that required for sensible heat exchange in the preheating zone, is transported back to the preheating zone where it supplies substantially all of the heat required for preheating subdivided solid material in that zone. If pneumatic transport is employed, suitable carrier gases in this phase of the process include air, steam and inert gases such as nitrogen and flue gas, with hot flue gas from the carrier heating zone being preferred.

The specific temperatures to which the particulate residue is cooled and the first particulate heat carrier is heated in the heat recovery zone of the process of the invention will depend on a variety of factors including the temperatures employed in retorting — i.e., the temperatures of the incoming particulate residue — and the temperature to which the subdivided solid is preheated — i.e., the temperature of the first particulate heat carrier at the bottom outlet of the preheating zone. As a general matter, the temperature of the cooled particulate residue leaving the heat recovery zone according to the invention will be about 500° to 900° F below the retorting temperature. In the case of subdivided oil shale and like materials, retorting according to the invention suitably produces a particulate residue having a temperature of from about 850° to about 1100° F while the first particulate heat carrier leaving the bottom of the preheating zone generally has a temperature in the range of about 100° to about 250° F. Passing these two streams into countercurrent contact in the heat recovery zone of the process of the invention affords a heat carrier effluent having a temperature in the range of from about 550° to about 700° F and a cooled particulate residue having a temperature of from about 175° F to about 300° F.

The design of the heat recovery zone is preferably quite similar to the preheating zone design. More particulately, the heat recovery zone is preferably in the form of a vertically-oriented column or standpipe having appropriate inlets and outlets for particulate heat carrier, fluidizing and elutriating gases and particulate residue, the top or upper portion of the column being equipped with suitable deflecting device to distribute heat carrier flow uniformly across the column. In this case, however, it is preferred that the column reduce, rather than expand, in diameter with increasing height to compensate for contractions in fluidizing gas volume as it is cooled. As with the preheating zone, it is also preferred that the heat recovery zone be internally equipped with a plurality of baffles or grid plates to promote staging of the countercurrent heat exchange and to minimize backmixing. For practical scale heat recovery from retorted oil shale and like particulate residues, the heat recovery zone is suitably 8 to 20 feet in diameter and 50 to 200 feet in height. Preferably, the height of the heat recovery zone is about 100 feet for oil shale heat recovery according to the conditions described above. When baffles or grid staging are employed on a practical scale, it is preferable to use about 5 to 20 sets of baffles or horizontal grid plates spaced at uniform intervals of about 5 to 20 feet along the axis of the heat recovery zone.

Reference is made to the drawing which shows an embodiment of the process in accordance with the invention.

In the embodiment shown, raw crushed oil shale is fed via line 1, which is typically a conveyor belt or other mechanical carrying device, to a ball mill, 2, where it is ground to a nominal size of less than 1/16 inch. This milled or comminuted oil shale is then passed by line 3, suitably a gravity or screw feeding device, at a temperature of about 50° F into the bottom of the preheating zone, 4, at a controlled rate. There, the comminuted shale is picked up by a fluidizing gas introduced into the preheating zone by line 5 and carried up through the preheating zone in the form of a dilute-phase fluidized bed. In this embodiment the fluidizing gas is compressed air diluted with flue gas at about 170° F from the heat recovery phase of the process, as will be detailed below. Simultaneously with the introduction of comminuted shale as a dilute-phase fluidized bed in the preheating zone, 4, a first particulate heat carrier in the form of ¼ inch diameter ceramic or ⅛ steel balls having a zone inlet temperature of about 675° F is introduced via line 6 and rained downwardly at a substantially uniform non-accelerating rate under the influence of gravity through the dilute-phase fluidized bed. On entering the top portion of the preheating zone, 4, the heat carrier balls impact on a conical deflector plate (not shown) to distribute their flow uniformly over the cross-section of the preheating zone. Sensible heat exchange effected countercurrently in this zone raises the temperature of the fluidized oil shale particles to about 550° F at the top of the preheating zone. These preheated oil shale particles and carrier gas exit the top of the preheating zone via line 7 and pass into a gas-solids separation zone (cyclone separator), 8, where substantially all of the solid shale particles are separated without cooling and passed via line 9 at a temperature of about 550° F to the bottom of the retorting zone, 12. The fluidizing gas (air) containing a minor amount of very fine shale particles separated from the preheated oil shale in the gas-solids separation zone 8 is taken overhead via line 10 at a temperature of about 550° F and combined with the air-fuel gas feed to the carrier heating zone as will be detailed below. The first particulate heat carrier which falls at a substantially uniform rate under the influence of gravity through the dilute-phase fluidized bed in the preheating zone, 4, collects at the bottom of the zone at a temperature of about 150° F as a result of sensible heat exchange with the incoming fluidized shale particles. This relatively cool heat carrier, which contains a minor amount of entrained shale particles, is subject to elutriation with a slip stream of the fluidizing air in the lower portion of the preheating zone (not shown) and passed out of the bottom of the preheating zone substantially free of entrained shale particles via line 11 for pneumatic transport to the heat recovery zone, detailed below.

To effect retorting, the preheated shale at 550° F is passed via gravity and/or screw feeder device in line 9 to the lower portion of the retorting zone, 12, where it is carried in an upward direction as a dense-phase fluidized bed by superheated steam (1200° F) injected via line 13 and the vapors produced on retorting. Though not shown in the schematic FIGURE, it is preferred that this retorting zone be expanded in cross-sectional area in its upper portions to accommodate the vapor volume released on retorting without destroying the dense fluidized bed operation. Simultaneous with the upward passage of the dense fluidized bed of preheated shale in the retorting zone, a second particulate heat carrier in the form of ¼ inch diameter ceramic balls is passed downwardly from inlet line 14 at about 1400° F through the dense fluidized bed thereby heating the shale particles to about 900° F and supplying the pyrolysis heat requirement. As a result of retorting or pyrolysis in this zone, the preheating shale is converted into a vapor phase containing hydrocarbonaceous fluids and a particulate phase comprising a solid carbonaceous material-containing residue substantially at the temperatures of the dense fluidized bed (900° F). The retorted particulate residue which predominates in the dense fluidized bed in the retorting zone, e.g., 90%+ particulate residue, is removed via line 15 at about 900° F from the top of the dense fluidized bed and passed via gravity and/or screw feed to the bottom of the heat recovery zone, 27, detailed below. It is preferable to strip entrained vapors from the particulate residue in this line or in a separate vessel using superheated steam. The vapor overhead from the retorting zone containing the hydrocarbonaceous fluid product of retorting and associated fluidizing gas is removed via line 16 from the top of the retorting zone, after being freed from entrained fluidized solids by one or more internal cyclone separators (not shown), and passed to product recovery (not shown). This vapor overhead is at a temperature of about 900° F; therefore, to avoid formation of coke in the product transfer line, 16, superheated steam at 1200° F is injected via line 17 at one or more points along line 16 or in the top of vessel 12. Upon passing through the dense fluidized bed contained in the retorting zone, 12, and transferring sensible heat to the fluidized shale particles and retorted particulate residue, the second particulate heat carrier collects at the bottom of the retorting zone at a temperature of about 900° F along with a minor portion of entrained shale particles and retorted particulate residue. This second particulate heat carrier, now cooled to pyrolysis temperature, is separated from the entrained shale particles and particulate residue by elutriation with a slip stream of fluidizing steam in the bottom of the retort zone (not shown) and passed out the bottom of the retort zone at about 900° F essentially free of the entrained solids via line 18 into line 19 for pneumatic transport to the carrier heating zone, 21. In line 19, which is suitably a small diameter lift pipe, the second particulate heat carrier is entrained in a stream of compressed air introduced into line 19 via line 20 at a temperature of about 250° F which carries the particulate heat carrier up into the carrier heating zone, 21. In the carrier heating zone, the second particulate heat carrier is contacted directly with the hot flue gas from complete combustion of a fuel and heated to a temperature of about 1400° F. In this carrier heating zone, combustion is effected by combining an air and fuel gas composition introduced by line 22 and the preheated shale fines and fluidizing air in line 10 into a combustion supporting mixture in line 23 and passing same to the carrier heating zone for combustion. In this case, the gaseous components of the mixture act as a carrier gas for the preheated shale fines. The air utilized as the entraining gas for pneumatic transport of the heat carrier in line 19 also combines with the mixture of air and fuel in the carrier heating zone, 21, to supply part of the oxygen requirements for combustion. The flue gas employed in heating the second particulate heat carrier leaves the carrier heating zone via line 24 at a temperature of about 1400° F and splits into two flow streams carried by lines 25 and 26 with the flow stream in line 25 going to steam generation and disposal, as detailed below, and the flow stream in line 26 going to the heat recovery stage of the process for use as fluidizing gas and carrier gas for pneumatic transport, as detailed below.

To effect heat recovery the retorted particulate residue at about 900° F is passed via line 15 in the manner described above into the bottom portion of the heat recovery zone, 27, where it is carried in an upwards direction as a dilute-phase fluidized bed by the action of hot flue gas (1400° F) from the carrier heating zone, which is split off line 26 at line 28 for introduction into the bottom of the heat recovery zone. Sensible heat exchange is effected in the heat recovery zone in a manner similar to that employed in the preheating zone in that the first particulate heat carrier is passed via line 29 at a zone inlet temperature of about 100° F downwardly, in countercurrent fashion, through the dilute-phase fluidized bed at a substantially uniform velocity under the influence of gravity. This first particulate heat carrier, at low temperature in line 11 as a result of heat exchange in the preheating zone, is routed to the top of the heat recovery zone for introduction into that zone via line 29 by pneumatic transport in line 30. In line 30, which is suitably a small diameter lift pipe, the first particulate heat carrier is entrained in a stream of compressed air added to line 30 via line 31 at a temperature of about 180° F and carried up to a cyclone separator, 32, at the top of the heat recovery zone. In this cyclone separator, the first particulate heat carrier is separated from the entraining gas for introduction into the heat recovery zone via line 29 and the air carrier gas is taken overhead for use as the fluidizing gas in the preheating zone (via line 5). After sensible heat exchange in the heat recovery zone, the particulate residue passes out the top of that zone as a dilute fluidized phase via line 33 at a temperature of about 200° F. This cooled particulate residue and associated fluidizing gas are passed into a gas-solids separation zone, 34, (cyclone separator) where the essentially solids-free fluidizing gas is taken overhead via line 35 for disposal as indicated below and the separated particulate residue is dropped via line 36 at a temperature of about 200° F into a moisturizer, 37. In this moisturizer the particulate shale residue is wetted with water to reduce its tendency to generate fines dust and the wetted residue or spent shale is passed to disposal via line 38. After passing through the dilute-phase fluidized bed in the heat recovery zone, 27, the first particulate heat carrier collects at the bottom of the heat recovery zone along with a minor amount of entrained particulate residue. This particulate heat carrier is now at a temperature of about 620° F which is sufficiently high to supply substantially all of the heat required in the preheating zone, 4. Prior to being recycled to the preheating zone, this first particulate heat carrier is separated from entrained particulate residue by elutriation with a slip stream of the flue gas used as the fluidizing medium in the heat recovery zone (not shown). After separation of entrained particulate residue, the first particulate heat carrier is passed out of the bottom of the heat recovery zone via line 39 into line 40 where it is picked up and pneumatically transported to the top of the preheating zone, 4, with hot flue gas (1400° F) from the carrier heating zone, introduced into line 40 via line 26, being the entraining gas. This hot flue gas carrier functions to further heat the first particulate heat carrier such that it enters the cyclone separator 41 at the top of the preheating zone at a temperature of about 675° F or that required for preheating. In the cyclone separator, 41, the first particulate heat carrier is recovered from the entraining flue gas and dropped via line 6 into the preheating zone. The flue gas taken overhead from the cyclone separator, 41, at a temperature of about 675° F in line 42 is combined with the portion of the hot flue gas from the carrier heating zone split off at line 25 to form a flue gas having a temperature of about 1000° F in line 43. This 1000° F flue gas is passed through a waste-heat boiler, 44, for partial cooling and generation of high pressure steam. The partially cooled flue gas effluent leaves the waste-heat boiler at a temperature of about 500° F in line 45 and is combined with the flue gas separated from the top of the heat recovery zone in line 35 to give a combined flue gas effluent in line 46. This combined flue gas effluent is dedusted in a venturi scrubber, 47, with a 150° F water introduced via line 48 and the purified flue gas exhaust is taken overhead via line 49 at about 175° F for disposal. The bottoms from this scrubber, consisting mainly of water with a minor amount of particulate matter susbstantially in the form of retorted shale residue, may be recycled via line 50 to the water feed line 48 for the venturi scrubber, or passed via line 51 to the moisturizer for disposal.

While the invention has been illustrated with particular apparatus, those skilled in the art will appreciate that, except where specified, other equivalent or analogous units may be employed. The term "zones," as employed in the specification and claims, includes, where suitable, the use of segmented equipment operated in series, or the division of one unit into multiple units because of size constraints, etc. For example, the preheat zone might comprise two separate preheat columns in which the heat carrier falling to the lower portion of the first column would be introduced into the upper portion of the second column, the solid material from the upper portion of the second column being fed into the lower portion of the first column. Parallel operation of units, is of course, well within the scope of the invention.

What is claimed is:

1. A retorting process for recovery of hydrocarbonaceous fluids from solid material containing non-volatile carbonaceous materials comprising:

(a) countercurrently contacting said solid material subdivided to a particle size fluidizable in gas in the form of a relatively cool, upwardly moving fluidized mass in a vertically-oriented preheating zone with an inert relatively hot first particulate heat carrier thereby transferring sensible heat from the heat carrier to the subdivided solid material and heating said solid material to an elevated temperature below that required for retorting, said subdivided solid material being fluidized in gas in a manner to create a dilute-phase fluidized mass in the preheating zone and said particulate heat carrier being introduced in the upper portion of the preheating zone and having a particle size and density such that it falls through the dilute-phase fluidized mass at a substantially uniform rate and collects in the lower portion of the vertical preheating zone as a relatively cool first particulate heat carrier;

(b) recovering the bulk of said subdivided solid material at elevated temperature in the upper portion of said preheating zone and passing said recovered solid material to a retorting zone;

(c) recovering said relatively cool first particulate heat carrier in the lower portion of said preheating zone, and passing said recovered heat carrier to a heat recovery zone;

(d) introducing said subdivided solid material at elevated temperature into a vertically-oriented retorting zone as a dense phase, fluidized mass, and countercurrently contacting said fluidized mass in gas with a second inert particulate heat carrier heated to a temperature above that required for retorting to transfer sensible heat from the heat carrier to the subdivided solid material to obtain a vapor phase containing hydrocarbonaceous fluids and a solid particulate phase comprising a solid carbonaceous material-containing residue, said second particulate heat carrier being preheated in a separate heating zone and introduced in the upper portion of the retorting zone wherein its particle size and density are such that it falls at a substantially uniform rate and collects in the lower portion of the vertical retorting zone along with a minor amount of entrained solid material and solid carbonaceous material-containing residue;

(e) recovering said hydrocarbonaceous fluids from the upper portion of said retorting zone;

(f) separating said second particulate heat carrier in the lower portion of said retorting zone from solid carbonaceous material-containing residue and passing said separated heat carrier to a carrier heating zone wherein the carrier's temperature is raised to a level above that required for retorting, and returning said second particulate heat carrier after heating to the upper portion of the retorting zone;

(g) removing solid carbonaceous material-containing residue from the upper portion of the dense fluidized phase in the retorting zone and passing the residue to a heat recovery zone;

(h) introducing the solid carbonaceous material-containing residue from the retorting zone into a heat recovery zone, and countercurrently contacting said residue in gas with the relatively cool, first particulate heat carrier from the preheating zone to transfer sensible heat from the residue to the first particulate heat carrier and form a relatively hot first particulate heat carrier, and returning said relatively hot first particulate heat carrier to the preheating zone;

(i) recovering said relatively cool particulate residue from the heat recovery zone.

2. The process according to claim 1, wherein the solid material is selected from the class consisting of oil shale, coal and lignite.

3. The process according to claim 2, wherein the solid material is oil shale.

4. The process according to claim 3, wherein the subdivided solid material is heated to sensible heat transfer in the preheating zone to an elevateed temperature which is at least 250° F below the temperature required for retorting.

5. The process according to claim 4, wherein retorting of the preheated solid material in the dense fluidized bed of the retorting zone is carried out at about 850° to 1100° F by sensible heat transfer from the second particulate heat carrier introduced into the retorting zone at a temperature of from about 200° to about 700° F above that required for retorting.

6. The process according to claim 5, wherein the particulate residue is cooled to a temperature of about 150° to 300° F by sensible heat transfer to the first particulate heat carrier in the heat recovery zone.

7. The process according to claim 6, wherein the subdivided oil shale is introduced into the preheating zone at a temperature of 100° F or less and preheated by sensible heat exchange with the first particulate heat carrier to a temperature of from about 500° to about 600° F, said first particulate heat carrier being introduced into the preheating zone at a temperature of between about 600° and about 700° F and separated in the lower portion of said preheating zone after sensible heat exchange at a temperature of about 100° to about 250° F.

8. The process according to claim 7, wherein retorting of the preheated oil shale in the dense fluidized bed of the retorting zone is carried out at a temperature of 850° to 1100° F by sensible heat transfer from the second particulate heat carrier introduced into the retorting zone at a temperature of from about 1100° F to about 1650° F.

9. The process according to claim 8, wherein the preheated solid material is fluidized as a dense-phase fluidized mass in the retorting zone with a non-combustion supporting gas selected from the class consisting of nitrogen, flue gas, steam and gaseous mixtures made up substantially of light hydrocarbons.

10. The process according to claim 9, wherein the carrier heating zone for heating the second particulate heat carrier comprises a combustion heater or furnace wherein the second particulate heat carrier is heated directly or indirectly with hot flue gas product of combustion.

11. The process according to claim 10, wherein the first particulate heat carrier is made up of a solid, inert material selected from the class consisting of aluminum, iron, steel, lead alloys, ceramic and pea gravel, and the second particulate heat carrier is made up of a solid, inert material selected from the class consisting of iron, steel, and ceramic.

12. The process according to claim 11, wherein the first particulate heat carrier is made up of pea gravel or ceramic and the second particulate heat carrier is composed of ceramic.

13. The process according to claim 12, wherein the solid material is fluidized as a dilute phase fluidized mass in the preheating zone with a fluidizing gas selected from the class consisting of air, flue gas-diluted air, flue gas, steam and nitrogen.

14. A retorting process for recovery of hydrocarbonaceous fluids from solid material containing nonvolatile carbonaceous material, leaving upon retorting a solid carbonaceous material-containing residue, which comprises:

(a) countercurrently contacting said solid material subdivided to a particle size fluidizable in gas in the form of a relatively cool, upwardly moving fluidized mass in a vertically-oriented preheating zone with an inert relatively hot first particulate heat carrier thereby transferring sensible heat from the heat carrier to the subdivided solid material and heating said solid material to an elevated temperature below that required for retorting, said subdivided solid material being fluidized in gas in a manner to create a dilute-phase fluidized mass in the preheating zone and said particulate heat carrier being introduced in the upper portion of the preheating zone and having a particulate size and density such that it falls through the dilute-phase fluidized mass at a substantially uniform rate and collects in the lower portion of the verticle preheating zone as a relatively cool first particulate heat carrier along with a minor amount of entrained solid material;

(b) recovering the bulk of said subdivided solid material at elevated temperature in the upper portion of said preheating zone and passing said recovered solid material to a retorting zone;

(c) recovering said relatively cool first particulate heat carrier in the lower portion of said preheating zone by elutriation of entrained solid material, and pneumatically transporting said separated heat carrier to a heat recovery zone;

(d) introducing said subdivided solid material at elevated temperature into a vertically-oriented retorting zone as a dense phase, fluidized mass, and countercurrently contacting said fluidized mass in gas with a second inert particulate heat carrier heated to a temperature above that required for retorting to transfer sensible heat from the heat carrier to the subdivided solid material to obtain a vapor phase containing hydrocarbonaceous fluids and a solid particulate phase comprising a solid carbonaceous material-containing residue, said second particulate heat carrier being preheated in a separate heating zone and introduced into the upper portion of the retorting zone wherein its particle size and density are such that it falls at a substantially uniform rate and collects in the lower portion of the vertical retorting zone along with a minor amount of entrained solid material and solid carbonaceous material-containing residue;

(e) recovering said hydrocarbonaceous fluids from the upper portion of said retorting zone;

(f) separating said second particulate heat carrier in the lower portion of said retorting zone by elutriation of entrained solid material and solid carbonaceous material-containing residue and pneumatically transporting said separated heat carrier to a carrier heating zone wherein its temperature is raised to a level above that required for retorting and returning said second particulate heat carrier after heating to the upper portion of the retorting zone;

(g) removing said carbonaceous material-containing residue from the upper portion of the dense fluidized phase in the retorting zone and passing the residue to a heat recovery zone;

(h) introducing the solid carbonaceous material containing residue from the retorting zone into the lower portion of a vertically-oriented heat recovery zone to form an upwardly moving fluidized mass and countercurrently contacting the fluidized mass of said residue with the relatively cool, first particulate heat carrier from the preheating zone to transfer sensible heat from the residue to the first particulate heat carrier to form a relatively cool particulate residue in the upper portion of the heat recovery zone and a relatively hot first particulate heat carrier having a temperature approximating that required for sensible heat transfer in the preheating zone, said particulate residue being fluidized in gas in a manner to create a dilute-phase fluidized mass in the heat recovery zone and said first particulate heat carrier being introduced in the upper portion of the heat recovery zone and having a particle size and density such that it falls through the dilute phase fluidized mass at a substantially uniform rate and collects in the lower portion of the heat recovery zone along with a minor amount of entrained particulate residue;

(i) separating said relatively hot first particulate heat carrier from the lower portion of said heat recovery zone by elutriation of entrained particulate residue, and pneumatically transporting said separated heat carrier to the solid material preheating zone to supply heat for preheating said solid material; and (j) recovering said relatively cool particulate residue from the upper portion of heat recovery zone.

15. The process according to claim 14, wherein the solid material is selected from the class consisting of oil shale, coal and lignite.

16. The process according to claim 15, wherein the solid material is oil shale.

17. The process according to claim 16, wherein the subdivided solid material is heated by sensible heat transfer in the preheating zone to an elevated temperature which is at least 250° F below the temperature required for retorting.

18. The process according to claim 17, wherein retorting of the preheated solid material in the dense fluidized bed of the retorting zone is carried out at about 850° to 1100° F by sensible heat transfer from the second particulate heat carrier introduced into the retorting zone at a temperature of from about 200° to about 700° F above that required for retorting.

19. The process according to claim 18, wherein the particulate residue is cooled to a temperature of about 150° to about 300° F by sensible heat transfer to the first particulate heat carrier in the heat recovery zone.

20. The process according to claim 19, wherein the subdivided oil shale is introduced into the preheating zone at a temperature of 100° F or less and preheated by sensible heat exchange with the first particulate heat carrier to a temperature of from about 500° to about 600° F, said first particulate heat carrier being introduced into the preheating zone at a temperature of between about 600° and about 700° F and separated at the bottom of said preheating zone after sensible heat exchange at a temperature of about 100° to about 250° F.

21. The process according to claim 20, wherein retorting of the preheated oil shale in the dense fluidized bed of the retorting zone is carried out at a temperature of 850° to 1100° F by sensible heat transfer from the second particulate heat carrier introduced into the retorting zone at a temperature of from about 1100° to about 1650° F.

22. The process according to claim 21, wherein the first particulate heat carrier is made up of a solid, inert material selected from the class consisting of aluminum, iron, steel, lead alloys, ceramic and pea gravel, and the second particulate heat carrier is made up of a solid, inert material selected from the class consisting of iron, steel, and ceramic.

23. The process according to claim 22, wherein the first particulate heat carrier is made up of pea gravel or ceramic and the second particulate heat carrier is composed of ceramic.

24. The process according to claim 23, wherein the residence time of the fluidized solid material and particulate residue in the preheating and heat recovery zones, respectively, is maintained between about 15 and 50 seconds and the residence time of the preheated solid material in the dense fluidized bed of the retorting zone is controlled between about 5 and 20 minutes.

25. The process according to claim 24, wherein the solid material is fluidized as a dilute-phase fluidized mass in the preheating zone with a fluidizing gas selected from the class consisting of air, flue gas-diluted air, flue gas, steam and nitrogen.

26. The process according to claim 22, wherein the preheated solid material is fluidized as a dense-phase fluidized mass in the retorting zone with a non-combustion supporting gas selected from the class consisting of nitrogen, flue gas, steam and gaseous mixtures made up substantially of light hydrocarbons.

27. The process according to claim 26, wherein the particulate residue is fluidized as a dilute-phase fluidized mass in the heat recovery zone with a fluidizing gas selected from the class consisting of flue gas, steam and nitrogen.

28. The process according to claim 27, wherein the separate carrier heating zone for heating the second particulate heat carrier comprises a combustion heater or furnace wherein the second particulate heat carrier is heated directly or indirectly with hot flue gas product of combustion.

29. The process according to claim 28, wherein the hot flue gas generated by combustion in the separate carrier heating zone is utilized as the fluidizing gas in the heat recovery zone and as the carrier gas for pneumatic transport of the first particulate heat carrier from the heat recovery zone to the preheating zone.

30. The process according to claim 29, wherein the air fluidizing gas and entrained, subdivided oil shale not recovered at the upper portion of the preheating zone is passed to the combustion heater or furnace of the separate carrier heating zone for the second particulate heat carrier and combusted therein to supply at least a portion of the heat requirement of that zone.

* * * * *